US005444887A

United States Patent [19]

Rufolo

[11] Patent Number: 5,444,887

[45] Date of Patent: Aug. 29, 1995

[54] METHOD AND DEVICE FOR CLEANING UNDERWATER PIPES

[76] Inventor: Paul G. Rufolo, 149 Gregory St., Mt. Prospect, Ill. 60056

[21] Appl. No.: 801,820

[22] Filed: Dec. 4, 1991

[51] Int. Cl.[6] ..... B08B 9/04

[52] U.S. Cl. ..... 15/104.31; 15/104.05; 134/167 C; 134/168 C; 134/172; 134/8

[58] Field of Search ..... 15/104.31, 104.05, 104.16; 134/167 C, 168 C, 172, 8

[56] References Cited

U.S. PATENT DOCUMENTS

| | | | |
|---|---|---|---|
| 494,427 | 3/1893 | Lacroix et al. | 15/104.31 |
| 813,028 | 2/1906 | Thompson | 15/104.16 |
| 951,202 | 3/1910 | Shirk | 15/104.31 |
| 1,446,224 | 2/1923 | Thompson et al. | 15/104.31 |
| 1,972,402 | 9/1934 | Jones | 15/104.31 |
| 2,354,245 | 7/1944 | Corbosiero | 15/104.31 |
| 3,321,184 | 5/1967 | Goss | 254/134.4 |
| 3,380,461 | 4/1968 | Maasberg et al. | 134/167 |
| 3,685,083 | 8/1972 | Jones | 15/104.06 |
| 4,182,497 | 1/1980 | Ferreira et al. | 239/532 |
| 4,216,910 | 8/1980 | Kimbrough | 239/456 |
| 4,237,913 | 12/1980 | Maasberg | 134/167 |
| 4,269,264 | 5/1981 | Goeldner | 165/95 |
| 4,271,556 | 6/1981 | Farrell, Jr. | 15/104.31 |
| 4,326,893 | 4/1982 | Clifford | 15/104.31 |
| 4,337,096 | 6/1982 | Clifford | 15/104.31 |
| 4,356,039 | 10/1982 | Clifford | 15/104.31 |
| 4,498,932 | 2/1985 | Kruka | 134/8 |
| 4,699,163 | 10/1987 | Bazuik | 134/167 |
| 4,715,538 | 12/1987 | Lingnan | 239/248 |
| 5,069,722 | 12/1991 | Murphy | 15/104.16 |

FOREIGN PATENT DOCUMENTS

| | | | |
|---|---|---|---|
| 299371 | 7/1917 | Germany | 15/104.31 |

*Primary Examiner*—David A. Scherbel
*Assistant Examiner*—Gary K. Graham

[57] ABSTRACT

A bladed cylindrical member with high pressure fluid jet nozzles cuts and sweeps aquatic foreign matter from the inside surface of underwater pipes. The method for removing the foreign matter includes reciprocally pulling the device through the pipe and injecting high pressure air into a containment area to force any extricated foreign matter to the surface.

19 Claims, 4 Drawing Sheets

METHOD AND DEVICE FOR CLEANING UNDERWATER PIPES

FIELD OF THE INVENTION

This invention relates to underwater conduit cleaning systems and apparatus for removing blockage due to organism or animal growth inside a conduit. More particularly, this invention relates to bladed devices for removing zebra mussel growth and other undesirable aquatic infestation from the inside of underwater conduits such as water intake pipes.

BACKGROUND OF THE INVENTION

The zebra mussel or Dreissena polymorph is a bivalve mollusk native to Europe. This organism has been unintentionally introduced into North American waters by the discharge of ballast water from transoceanic ships. Adult zebra mussels spread rapidly because the adults produce a free-floating reproductive stage called a veliger. Veligers are planktonic young that may drift in currents for up to 30 days. These larvae are abundant and small, and are able to pass through water intake pipe grates and infest the interior of the intake pipes. Often these intake pipes may be several miles long.

These mussels have already attached themselves to the submerged parts of municipal water systems, including intake pipes, which has greatly restricted the inflow of water to electrical generating and water treatment facilities, by reducing the diameter of the available water flow area inside the intake pipe. The zebra mussel is harmful to water systems, and are capable of colonizing on any firm substrate. Intake screens and pipes are especially good for mussel colonization due to the abundance of food near the intake pipe screens. Colonies form that may be over seven inches thick.

Current cleaning devices and methods require the municipality to cease use of the pipe for many months while the cleaning operation is carried out. Typical pipe cleaning operations use either pressurized fluids to propel and clean dirt or sludge in pipes, or use pipe pigs with rubber seals that conform to the inside of the pipe. However, such systems typically are limited to up to 48" diameter pipes and are very expensive to operate to remove this type of underwater aquatic infestation. Another problem is that municipalities can not afford to close off intake pipes for an extended period of time to allow for cleaning.

Consequently, there exists a need for an effective underwater pipe cleaning device that is capable of removing unwanted aquatic infestation such as zebra mussels without causing extended shut down of the use of the pipe. Furthermore, there exists a need for a cleaning device that may be inserted regardless of the extent of infestation in the pipe.

SUMMARY OF THE INVENTION

These needs and others have been substantially met by the method and device for cleaning underwater pipes disclosed below. The inventive cleaning device, for removing an aggregation of foreign matter adhered to an inside surface of an underwater conduit, includes a member, such as a cylindrical ring, having a blade-like front surface and a blade-like rear surface for scraping the foreign matter from the inside surface of the conduit; forward attachment pads, coupled to the member, for attaching a system for generating forward movement of the member through the underwater conduit such as a forward pull rod assembly and accompanying winches; and rearward attachment pads, coupled to the member, for attaching a system for generating reverse movement of the member through the underwater conduit such as a rear pull rod assembly and accompanying winches. The attachment pads are welded to the member. A plurality of additional radial cutting blades are mounted on an inner surface of the member, with each cutting blade having a front cutting edge and a rear cutting edge.

The member has an outer surface of a size and shape generally conforming to the inside surface of the underwater conduit. The member is supported upon an axial member, such as a cylindrical tank, by a plurality of radial braces. These radial braces also have a front cutting edge and a rear cutting edge. The cleaning device also includes fluid jet nozzles for producing a jet stream used in transferring the foreign matter along the pipe's floor. The axial tank facilitates high pressure fluid expulsion through the jet nozzles.

The method includes inserting the bladed cleaning device in the underwater conduit, moving the bladed cleaning device in a first axial direction causing the foreign matter to be extricated from the inside surface of the conduit and moving the bladed cleaning device in a second axial direction opposite the first direction causing the jet stream to transport the extricated foreign matter in the second axial direction.

DETAILED DESCRIPTION OF THE INVENTION

Figures 1, 2:
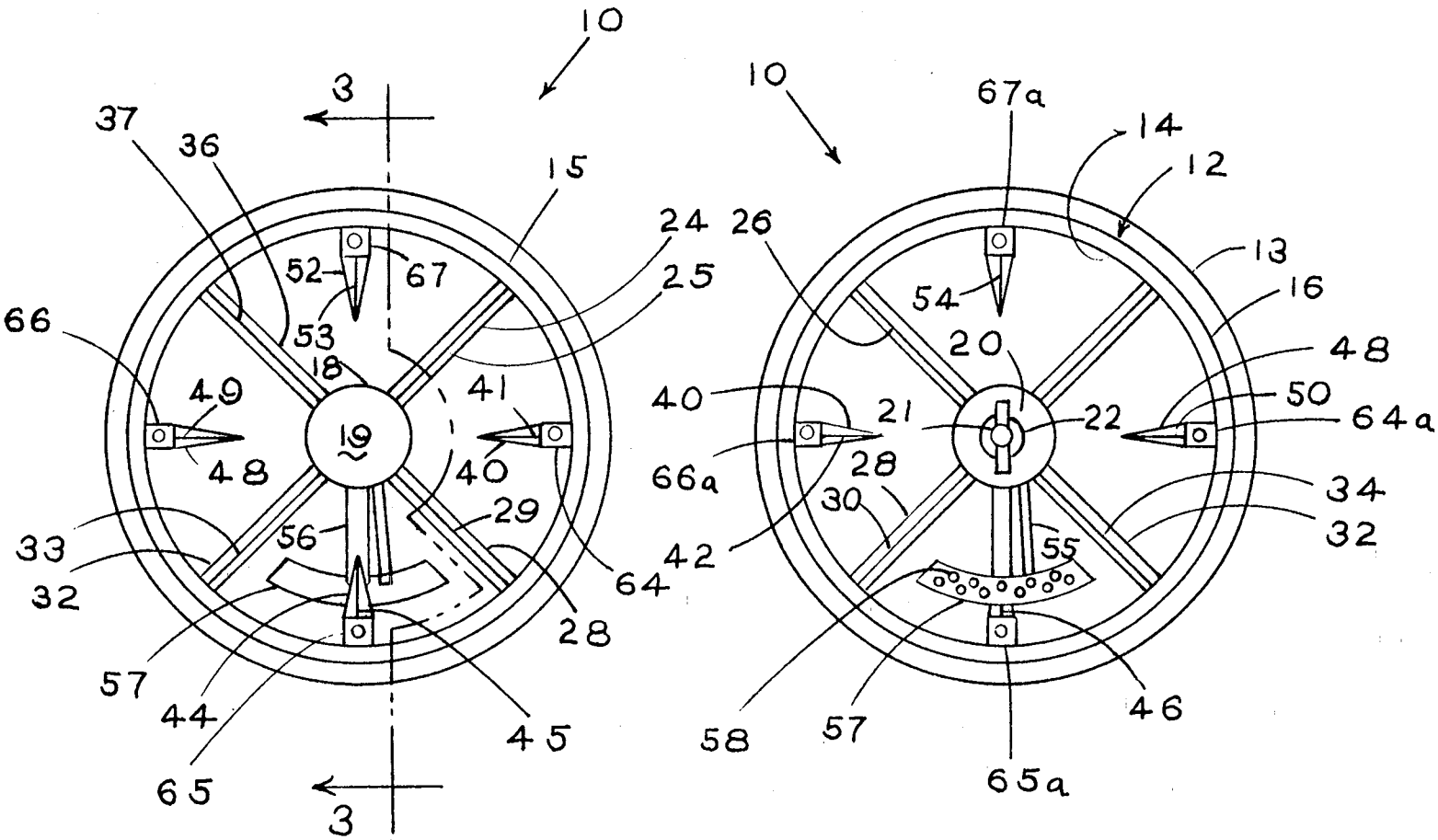
FIG. 1 is a front view of the cleaning device in accordance with the invention.
FIG. 2 is a rear view of the cleaning device in accordance with the invention.
Figure 1A:
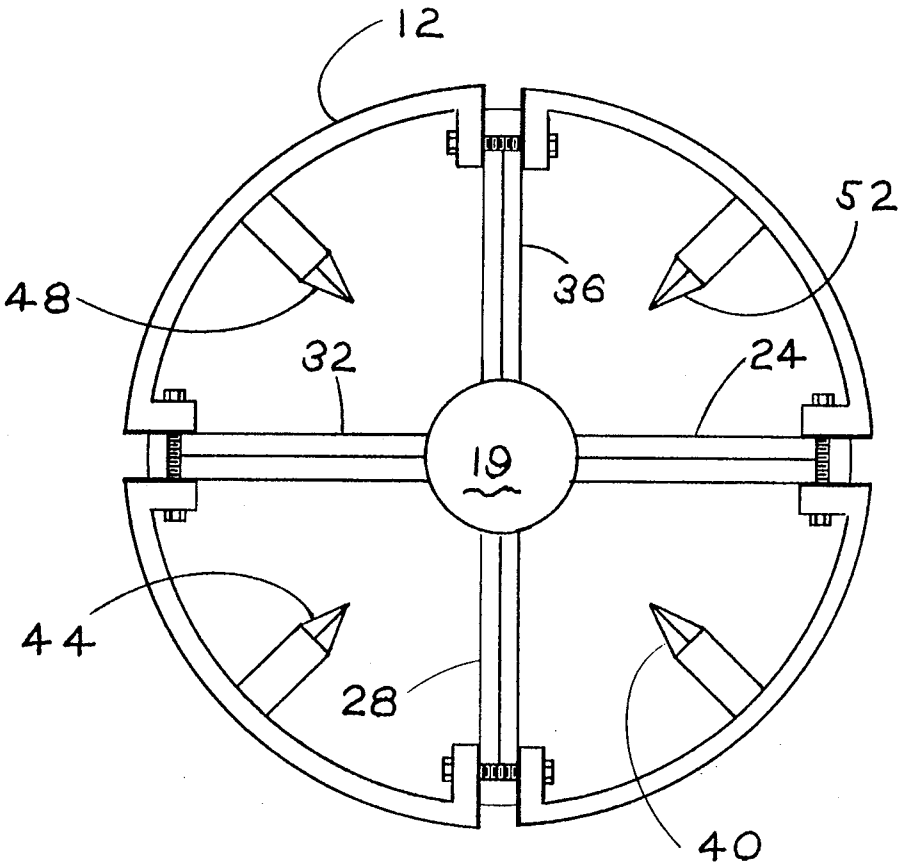
FIG. 1A is a front view of the cleaning device of FIG. 1, except showing it in greater detail.

FIG. 1 generally depicts a front view of the conduit cleaning device 10 that includes a cylindrical member 12, radial cutting blades 40, 44, 48, and 52, front pad eyes 64, 65, 66, and 67, an axial support member 18, radial braces 24, 28, 32, and 36, and a jet spray head 57.

The cylindrical member 12 has an outer annular surface 13 and an inner annular surface 14. The outer annular surface 13 has a size and shape generally conforming to the inside surface of the underwater conduit. A front cutting edge 15 extends about the circumferential front end of the cylindrical member 12.

The radial cutting blades 40, 44, 48, and 52 are bolted, welded, or otherwise mounted on the annular inner surface 14 of the cylindrical body 12. The radial cutting blades 40, 44, 48, and 52 each include a front cutting edge 41, 45, 49, and 53, respectively. The radial lengths of the radial cutting blades 40, 44, 48, and 52 are adjustable. This is accomplished by mounting the blades to slide in a groove and bolted or pinned to a plate comprising the groove, as is known.

The axial support member 18 or element is located in the center of the cylindrical member 12 and serves both as structural support and as a tank for storing pressurized liquid, which will be discussed later. Structural support and additional cutting capability is provided by the radial braces 24, 28, 32, and 36. Each of these radial braces include a cutting edge 25, 29, 33, and 37, respectively. These radial braces are attached to the tank 18 using bolts, however, any other suitable attachment method may be employed such as welding or brazing. The distally opposite ends of each of these radial braces 24, 18, 32, and 36 is attached to the inner annular surface 14 of the cylindrical member 12 using bolts.

The front pad eyes 64, 65, 66, and 67 include eyelets and are welded to the inner annular surface 14 under or adjacent to the radial cutting blades 40, 44, 48, and 52. These pad eyes serve as coupling mechanisms for pull rods (shown in FIG. 3) which are attached to the member 12 for pulling the conduit cleaning device 10 through a conduit. The front pad eyes 64, 65, 66, and 67 help maintain forward movement of the member as it is pulled through the conduit.

A high pressure water line 56 is attached to the water tank 18 and is also coupled to the jet spray head 57. One end of a jet spray head stabilizer rod 55 is coupled to the tank 18 while the other end is coupled to a surface of the jet spray head 57. The jet spray head stabilizer rod 55 holds the head 57 securely during operation, using pipe threads in one embodiment.

FIG. 2 depicts a rear view of the cleaning device 10. The rear face of the cylindrical member 12 also has a rear cutting edge 16 which extends about the rear face of member 12. Similar to the front cutting edge 15, the rear cutting edge 16 is also formed by the outer annular surface 13 and the inner annular surface 14. The radial braces 24, 28, 32, and 36 also have rear knife edges 26, 30, 34, and 38, respectively. Similarly, radial cutting blades 40, 44, 48, and 52 have rear cutting edges 42, 46, 50, and 54, respectively. Rear pad eyes 64*a*, 65*a*, 66*a*, and 67*a* are mounted in the same manner as the front pad eyes 64, 65, 66, and 67. The rear pad eyes help maintain reverse movements of the clearing device through the conduit. Another embodiment may include at least one hole through the radial cutting blades 40, 44, 48, and 52 as the coupling mechanism for the pull rods.

Figure 3:
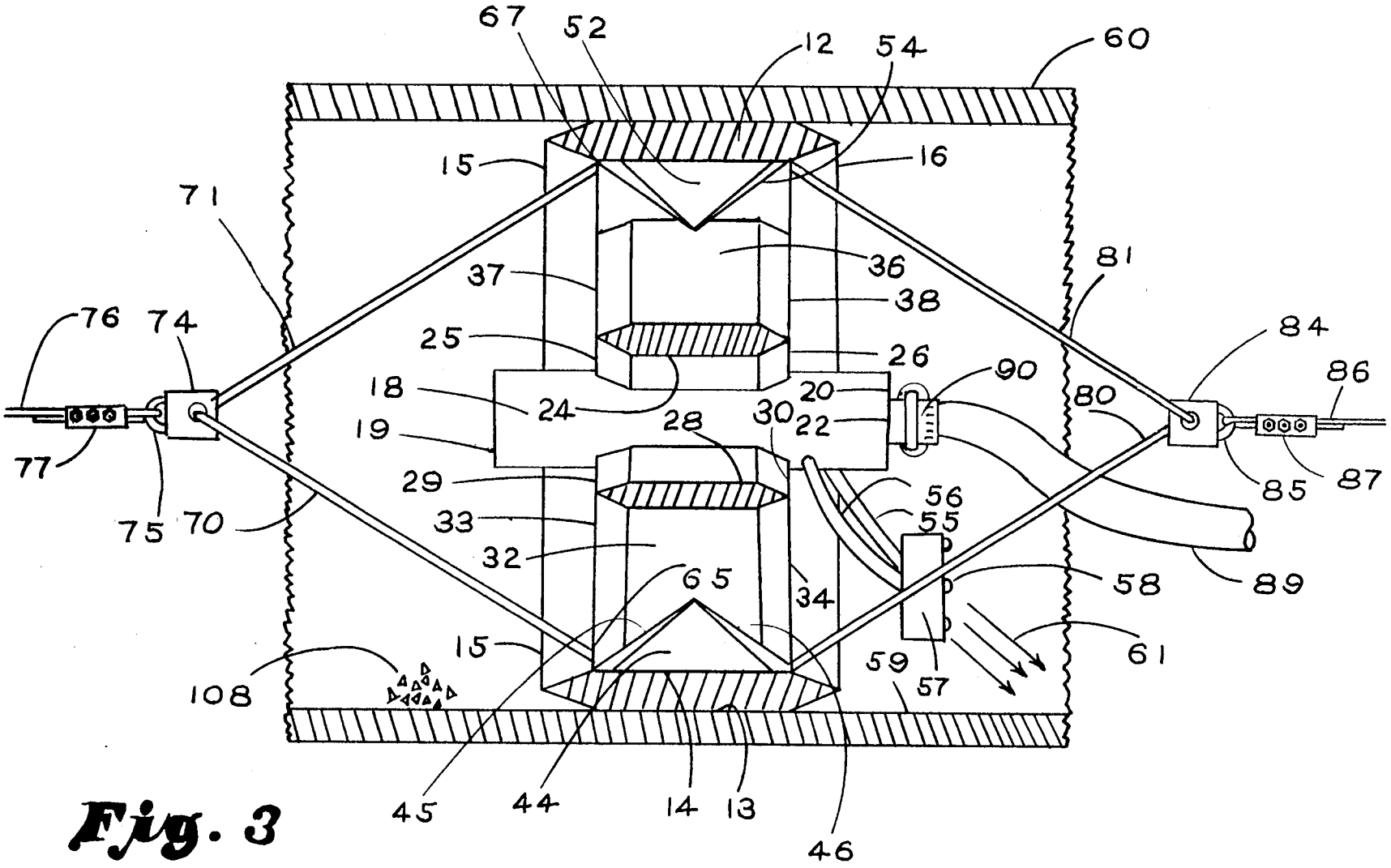
FIG. 3 is a cross-sectional view of the device of FIG. 1 and FIG. 2 as it appears: in an underwater conduit.

The axial support tank 18 has a rear face 20 with an aperture 21 for receiving a high pressure hose (see FIG. 3). A hose is connected to the aperture 21 using a hose connection fixture 22. The jet spray head 57 includes a plurality of jet spray nozzles 58 that are directed toward the inside floor surface of an underwater conduit.

The size and angle of all of the cutting edges vary according to the size of the pipe involved. For example, for a 42" pipe, the cylindrical member 12 may be 18" long and ½" thick at its thickest point; while the radial blades 40, 44, 48, and 52 may be 8" long. The cylindrical member 12 is made from stainless steel, but any other suitable material may also be used.

FIG. 3 shows a cross-sectional view of the conduit cleaning device 10 located inside an underwater conduit 60. The cleaning device 10 is able to remove secured mussels or other growth from the inner walls 59 of the conduit by being pulled in a forward direction and a backward direction. Pulling rods 70, 71 are each hooked in a separate eye of the pads 65 and 67, respectively. The front forward pulling rods 70 and 71 are coupled to a front draw bar element 74. A front cable ring 75 is coupled to the front draw bar element 74. A front pull cable 76 is coupled to the front cable ring 75 using a front cable clamping element 77. Forward motion is effectuated by pulling front pull cable 76.

In a similar manner, rear pulling rod 80 and rear pulling rod 81 are coupled to rear pad eyes 65*a* and 67*a* and to the rear draw bar element 84. A rear cable ring 85 is coupled to the rear draw bar element 84. A rear cable 86 is coupled to the rear cable ring 85 using a rear cable clamping element 87. Rearward motion is effectuated by pulling rear cable 86. Although not shown, two additional front forward pulling rods and two additional rear pulling rods are attached to the remaining pad eyes (64*a* and 66*a* not shown).

A high pressure flexible conduit 89, such as a high pressure fire hose or the like, is coupled to the axial tank 18 via the hose connection fixture 22. A hose connection fixture 90 mates with hose connection fixture 22 on the rear face 20 of the high pressure central tank 18.

The drawbars 74 and 84 are preferably made of steel and may have any suitable configuration. One suitable configuration may be a block structure wherein four square projections or teeth extend linearly from one end of the block to the other. Each of the square projections has a hole for receiving one of the forward pulling rods 70, 71, 72, and 73, or the rear pulling rods, 80, 81, 82, and 83. These pulling rods have hooks at both ends wherein one end couples to one of the holes in the drawbar element and the opposite end couples to an eye in a corresponding pad eye 64, 64*a*, 65, 65*a*, 66, 66*a*, 67 and 67*a*.

Another drawbar configuration may be a cross-type structure, "+", wherein an aperture is present in each one of the cross' extensions. Front and rear pull bars may then be configured as flat bars instead of rods to facilitate bolting of the flat bars to the cross-type drawbar.

Figure 4:
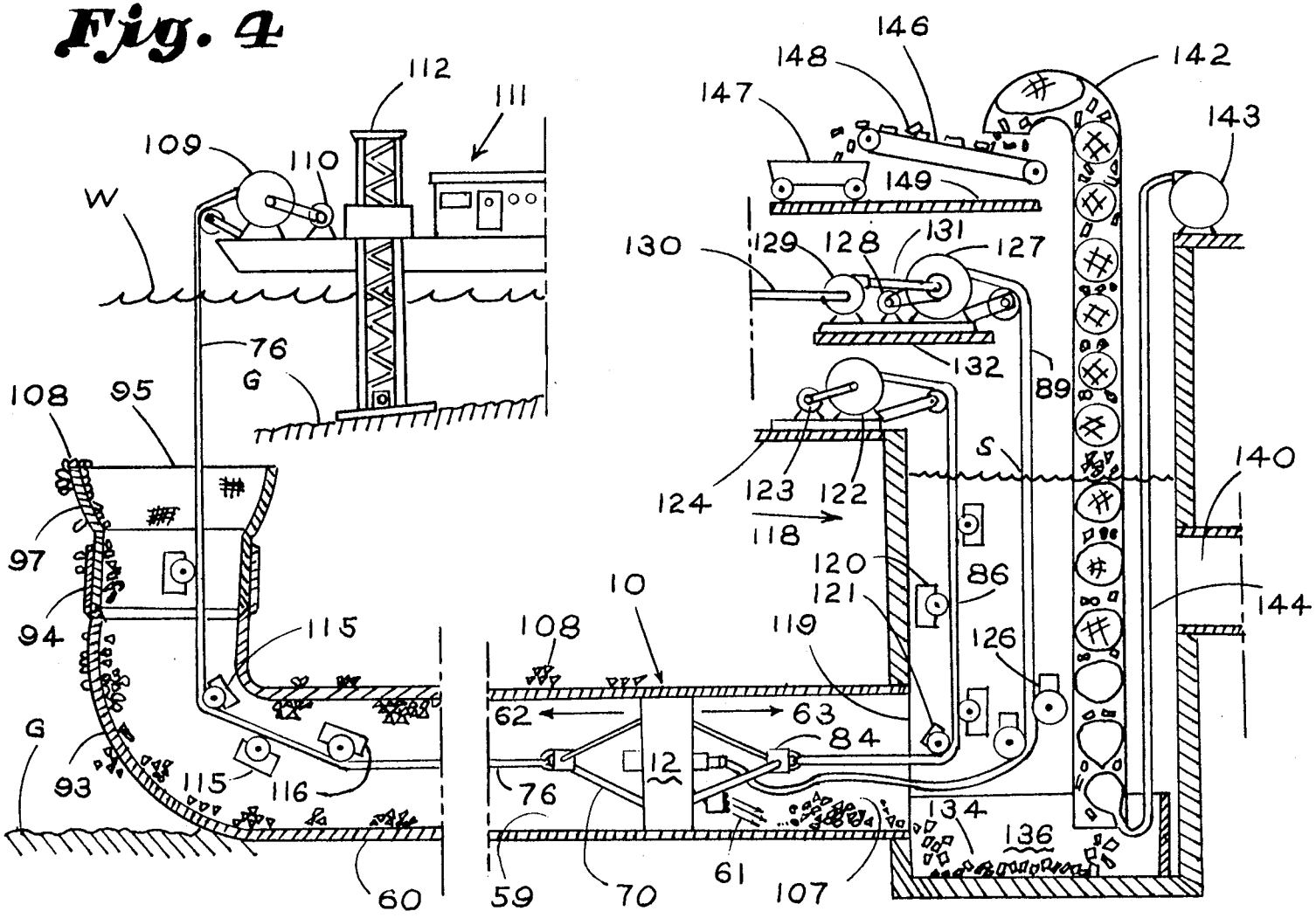
FIG. 4 is a cross-sectional view showing the operation of the cleaning device in accordance with the invention.

FIG. 4 illustrates the use of the cleaning device 10 in an underwater pipe 60 resting on an underwater surface G. The pipe 60 has an inlet elbow section 93, an expanded inlet collar 94, and a bell-shaped inlet screen 97. Aquatic infestation of living mussels and deceased mussels 108 are shown adhered to the pipe 60.

The pipe 60 connects to a municipal pump house. A typical municipal pump house includes a wet well 118 where water from the underground pipe 60 is discharged, and at least one pump suction line 140 extending to a water pump (not shown). The wet well 118 typically contains water having a surface level S above the pump suction line 140.

Back at the inlet of the pipe 60, a barge 111 held above the water surface W by support legs 112 contains a mounted variable speed motor 110 for controlling a single drum winch 109. This winch 109 and variable speed motor 160 control the movement of the front cable 76.

Located at the distal end of the pipe 60, at the pump house, is a skid mounted single drum cable winch 122 containing the rear cable 86, also controlled by a variable speed motor 123, controls the amount of reverse motion of the cleaning device 10. Also located at the pump house is a high pressure water pump 129, a tubular air lift 142, a high pressure air compressor 143, and a disposal system 146. These devices are used to remove and transport the extricated mussels from the inside of the pipe 60 to a disposal cart 147 in the pump house.

An on-shore high pressure water pump system, generally known in the art, provides the cleaning device 10 with the high pressure fluid for generating the underwater jet streams 61. This pump system includes a high pressure water pump 129, a pump suction line 130, a pump discharge line 131, a variable speed motor 128, and a skid mounted single drum winch 127 for the high pressure water hose 89.

The suction line 130 draws water, or any suitable fluid, from a water source whereafter the high pressure water pump 129 increases the pressure of the water in the discharge line 131 to a pressure suitable for providing adequate jet streams 61. The variable speed motor 128 controls the winch 127 which increases or decreases the length of hose 89 available to the cleaning device 10.

Inlet axial pulley assembly 116 centers the front cable 76 along the longitudinal axis of the underwater pipe 60. Additional inlet pulleys 115 prevent the front cable 76 from touching the wall of the underwater pipe. Pulleys 115, 116 are secured to the walls of the intake pipe by using screw-type jacks extending from the pulleys to the side walls of the pipe, or by other suitable means.

An outlet axial pulley assembly 121 is secured to the wall of wet well 118 and centers the rear cable 86 along the longitudinal axis of the underwater pipe 60. This outlet axial pulley assembly 121 is located in the wet well 118 just outside the outlet opening 119 of the pipe 60 where water is discharged into the wet well 118. Additional outlet pulleys 120 prevent the rear cable 86 from touching the interior wall of the wet well 118.

In operation, a construction or commercial diver or divers installs the cleaning device at the mouth or crib of the outlet opening 119 of the pipe 60 in the wet well 118. The cylindrical member 12 is sectionally divisible and may be split into two or more, and preferably four, equally sized pieces to provide ease of transport and assembly under water in the wet well or above water in the pump house. The segments may be bolted together, using suitable bolts and joining brackets, now shown. In addition, the radial cutting blades 40, 44, 48, and 52 may be adjusted in length. The forward winch 109 pulls the cleaning device 10 in a forward direction indicated by arrow 62. The bladed front surface 15 of the cylindrical member 12, the bladed front edges 41, 45, 49, and 53 of the radial cutting blades 40, 44, 48, and 52 and the bladed front knife edges 25, 29, 33, and 37 of the radial supports 24, 28, 32, and 36 cut the aggregation of deceased and living mussels 108 from the inner surface 59 of the underwater conduit 60. The cutting action caused by the cylindrical ring configuration of the cleaning device and its associated cutting blades lets the extricated mussels pass through the device 10 without clogging inside the interior of the device 10.

Once a sufficient forward distance has been travelled by the device 10, water under high pressure in the range of 300 psi is pumped through a fire hose 89 into the axial tank 18. The pressure in the tank causes water to be forced through the jet spray nozzles 58 in the jet spray head 57. The jet spray nozzles 58 are directed toward the floor 59 of the inside of the underwater conduit 60 so that jet streams of water force loose deposits of broken shells 107 rearwardly as indicated by the arrows 61.

A winch pulls the conduit cleaner 10 in a reverse direction indicated by arrow 63. This rearward motion enables the jet stream 61 to force extricated broken shells 107 into a containment area 134 or other suitable debris holding area. Water pressure in the intake pipe produced by the pumps in the pump house, may provide additional rearward force to assist removal of the extricated aggregations.

The removal system for transporting the loose deposits of broken shells includes a tubular air lift system 136, and a conventional disposal system. The tubular air lift system 136 includes the containment area 134 which is typically a three-walled enclosure for containing the loose mussels in an area small enough, to facilitate transport using a tubular air lift 142.

The tubular air lift 142 may be made of aluminum or other suitable material, and is usually in the range of eight to twelve inches in diameter. The high pressure air compressor 143 injects air up the tubular air lift 142, which is located proximate the containment area 134, through a high pressure air line 144. As air is injected into the tubular air lift 142, the loosened mussels are suctionally extracted up the air lift 142 and deposited into a conventional disposal system. Multiple tubular air lifts, such as a dual tubular air lift, may be used to increase the rate of extraction of the loosened mussels. The conventional disposal system may include a conveyor system 146 and a dumping cart 147. The disposal system is located on the floor of the pump house 149.

The high pressure water pump 129 should be large enough to develop 300 psig at the pump head to produce 50–75 psig at the jet spray nozzles 58. A larger pump may provide enough pressure to flush extricated shells through a one mile long pipe line.

The spray nozzles consist of seven $\frac{1}{8}''$ holes at a pressure of 100 psi. However, one of ordinary skill in the art will recognize that varying the pump pressure and varying the size of the jet spray nozzles may be advantageous depending upon the particular application.

The above described invention is capable of cleaning one mile of pipeline in approximately 30 hours assuming an inside pipe diameter of 72" and a 5"–10" thickness of mussel infestation throughout the circumference of the pipe line. Once a guide cable, either the front cable 76 or rear cable 86, is fed through the pipe, a diver in the pump station connects the front cable 76 and rear cable 86 to the cleaning device 10. The device 10 is pulled from the barge 111 end for approximately 200' whereafter the jet spray is activated and the cleaning device 10 is pulled back toward the pump station. This forward and backward pulling continues until the cleaning device 10 has been pulled the entire length of the pipe.

Although the preferred embodiment details a cylindrical cleaning member, other variations in shapes that generally conform to the interior of the underwater conduit may also be used. For example, an octagonal outer surface may provide sufficient contact with the inside of the conduit to facilitate adequate removal of the encrusted mussels.

Another embodiment of the invention may include only a partial front and rear blade face as may be desired where mussels are only colonized on the floor of a pipe so that the blades need only extend about a partial area of the circular face or rear of the cylindrical member.

An alternative embodiment of the cylindrical member may also include a snap-on blade edge so that the outer surface of the member and the inner surface of the member do not form the front and rear blade edges but instead act only as supports to which separate blades are affixed.

Specific embodiments of the cleaning device and method for using the same have been described for the purposes of illustrating the manner in which the invention may be used and made. It should be understood that the implementation of other variations and modifications of the invention is not limited by the specific embodiments described. It is therefor contemplated to cover by the present invention any and all modifications obvious to those having ordinary skill in the art.

What I claim is:

1. A cleaning device for removing shellfish obstructions from an interior surface of an underwater intake pipe comprising:

a curved outer member extended about a longitudinal axis, an inner member concentrically disposed on the longitudinal axis and radially spaced inwardly from the outer member, and a plurality of radial braces extending between the outer and inner members;

said outer member having inner and outer surfaces each extended parallel to the longitudinal axis, and a front cutting edge on said outer member proximate forward ends of the inner and outer surfaces;

a plurality of blades extending radially inward from the inner surface of said outer member toward but not reaching said inner member, each of said blades having opposed surfaces each extended parallel to the longitudinal axis, and a front cutting edge on each blade proximate forward ends of the respective opposed surfaces of the blades;

each of said braces having opposed surfaces each extended parallel to the longitudinal axis, and a front cutting edge on each brace proximate forward ends of the respective opposed surfaces of the blades; and means including connection apparatus coupled to forward and rearward ends of the outer member operable to be coupled to powered tow means running longitudinally through the underwater pipe, said tow means operable to move the cleaning device axially forwardly and rearwardly through the underwater pipe, whereby the obstructions are cored from the interior pipe surface by said front cutting edge on said outer member and are cut radially by said front cutting edges on said blades and said braces.

2. The device of claim 1 further comprising a rear cutting edge on said outer member proximate rearward ends of the inner and outer surfaces; a rear cutting edge on each blade proximate rearward ends of the respective opposed surfaces of the blade; and a rear cutting edge on each brace proximate rearward ends of the respective opposed surfaces of the brace, whereby the obstructions are further cored from the interior pipe surface by said rear cutting edge on said outer member and are cut radially by said rear cutting edges on said blades and said braces.

3. A cleaning device for removing shellfish from an interior surface of an underwater intake pipe up to several feet in diameter, comprising:

an annular outer member having a cylindrical outer surface extended along a longitudinal axis, a centrally located inner member extending axially along said longitudinal axis, said outer member being outwardly spaced radially from said inner member, and a plurality of radial braces extending between said inner and outer members at circumferentially spaced positions around said members;

a circular front cutting edge on a front of said outer member for coring said intake pipe when said cleaning device moves therethrough, said circular front cutting edge being generally perpendicular to said longitudinal axis;

front cutting edges on a front of said radial braces;

a plurality of cutting blades, distinct from said radial braces, extending radially inward from said outer member toward but not to said inner member, said cutting blades each having a respective front cutting edge and connection apparatus coupled to forward and rearward ends of the outer member operable to be coupled to powered tow means running longitudinally through the conduit, said tow means operable to move the cleaning device axially forwardly and rearwardly through the underwater pipe, and said outer member cylindrical outer surface being sized just slightly smaller than the interior pipe surface operable when said cleaning device is fitted inside and moved forward through the underwater pipe to provide that the obstructions are cored from the pipe by said circular front cutting edge and cut radially by said front cutting edges on said braces and said blades.

4. The device of claim 3 further comprising a rear circular cutting edge on a rear of said outer member; a rear cutting edge on a rear of each radial brace; a rear cutting edge on a rear of each cutting blade; and said radial braces extending substantially perpendicularly from said outer member to said inner member.

5. The device of claim 4 further wherein the connection apparatus includes front and rear centrally located devices axially separated from said outer member; and a plurality of connection members extending from said devices to engage said outer member at positions radially inward of said circular cutting edges.

6. The device of claim 5 further comprising a first cable-controlling device; a first cable controlled by the first cable-controlling device, the first cable extending from a barge into an opening of the underwater pipe to one of said front and rear connection devices; a shore-station having a second cable-controlling device; and a second cable controlled by said second cable-controlling device, the second cable extending from the shore-station to the other of said front and rear connection devices; and said first and second cables being part of the powered tow means.

7. The device of claim 3 further wherein said outer member is comprised of a number of separate components and means for sectionally holding the components together to provide that said outer member is divisible.

8. The device of claim 3 further comprising the inner member having means for discharging fluid toward a bottom of the interior pipe surface, and means for attachment of the fluid discharging means to a source of high pressure fluid to provide high pressure fluid discharge against the interior pipe surface, operable after the cutting edges of said cleaning device have removed the obstructions from the interior pipe surface for elevating such obstructions and foreign matter lying on the interior pipe surface into suspension with water in the pipe for carriage therewith of said water flowing through the pipe.

9. The cleaning device of claim 3 further comprising said braces and said blades being circumferentially spaced apart from one another and being alternately arranged around the outer member.

10. The cleaning device of claim 3 further comprising the cutting edges of said blades being angled relative to the longitudinal axis, in the inward direction radially and axially from the adjacent outer member end.

11. The cleaning device of claim 3 further comprising the cutting edges of said braces lying generally perpendicular to the longitudinal axis, and the cutting edges of said blades being angled relative to the longitudinal axis, in the inward direction radially and axially from the adjacent outer member end.

12. A cleaning device for removing foreign matter including shellfish obstructions from an interior surface of an underwater intake pipe having an elongated center axis, comprising:

an annular outer member having a longitudinal axis, and having inner and outer surfaces each extended parallel to the longitudinal axis, and forward and rearward circular cutting edges on said outer member proximate forward and rearward ends respectively of the inner and outer surfaces;

said outer member outer surface being shaped to complement the interior pipe surface and sized just slightly smaller than the interior pipe surface, operable to have said cleaning device fitted inside and moved axially through the pipe, with said annular cutting edges being disposed to engage and core the obstructions from the pipe;

a plurality of blades cantilevered radially inward from the inner surface of said outer member, each of said blades having opposed surfaces each extended parallel to the longitudinal axis, and forward and rearward radial blade cutting edges on each blade proximate forward and rearward ends respectively of the respective opposed surfaces, and the radial blade cutting edges meeting one another at an exposed intermediate location in spaced relationship from the outer member, operable to engage and further section the cored obstructions; and connection apparatus coupled to forward and rearward ends of the outer member operable to be coupled to powered tow means running longitudinally through the conduit, said tow means operable to move the cleaning device axially forwardly and rearwardly through the underwater pipe and core and section the shellfish obstructions as aforesaid.

13. The cleaning device of claim 12 further comprising the forward and rearward cutting edges of the blades being angled relative to the longitudinal axis, each in the inward direction radially and axially from the adjacent corresponding forward and rearward ends of the outer member.

14. The cleaning device of claim 12 further comprising the forward and rearward annular cutting edges of the outer member being entirely axially endwardly beyond the forward and rearward cutting edges of the blades.

15. A cleaning device for removing foreign matter including shellfish obstructions from an interior surface of an underwater intake pipe having an elongated center axis, comprising:

an annular outer member having a longitudinal axis, and having inner and outer surfaces each extended parallel to the longitudinal axis, and front and rear cutting edges on said outer member proximate forward and rearward ends respectively of the inner and outer surfaces;

said outer member outer surface being shaped to complement the interior pipe surface and sized just slightly smaller than the interior pipe surface, operable to have said cleaning device fitted inside and moved axially through the pipe, with said cutting edges being disposed to engage and core the obstructions from the pipe;

a plurality of cross braces extending radially inward from the inner surface of said outer member, each of said braces having opposed surfaces each extended parallel to the longitudinal axis, and forward and rearward cutting edges on each brace proximate the forward and rearward ends respectively of the opposed surfaces;

the axial separation between the forward and rearward cutting edges of the outer member being greater than the axial separation of the forward and rearward cutting edges of the braces, and the brace cutting edges lying entirely axially between the cutting edges of the outer member; and connection apparatus at the forward and rearward ends of the outer member operable to be coupled to powered tow means running longitudinally through the conduit, said tow means operable to move the cleaning device axially forwardly and rearwardly through the underwater pipe, whereby shellfish obstructions are cored from the pipe by said forward and rearward cutting edges on said outer member and are cut radially by said cutting edges on said braces.

16. The device of claim 15 further comprising a plurality of blades extending radially inward from the inner surface of said outer member, said blades being spaced from and between said braces, each of said blades having forward and rearward cutting edges at its forward and rearward ends respectively, operable for cutting radially the shellfish obstructions cored from the pipe.

17. The cleaning device of claim 16 further comprising the cutting edges of said braces lying generally perpendicular to the longitudinal axis, and the cutting edges of said blades being angled relative to the longitudinal axis, in the direction radially and axially inwardly from the adjacent end of the outer member.

18. The device of claim 17 further wherein said outer member is comprised of a number of separate components and means for sectionally holding the components together to provide that said outer member is divisible.

19. The device of claim 17 further comprising means carried on the device for discharging fluid toward a bottom of the interior pipe surface, and means for attachment of the fluid discharging means to a source of high pressure fluid to provide high pressure fluid discharge against the interior pipe surface, operable after the cutting edges of said cleaning device have removed the obstructions from the interior pipe surface for elevating such obstructions and foreign matter lying on the interior pipe surface into suspension with water in the pipe for carriage therewith of said water flowing through the pipe.

* * * * *